US005099558A

United States Patent [19]

Wilson

[11] Patent Number: 5,099,558

[45] Date of Patent: Mar. 31, 1992

[54] BURNISHING TOOL HOLDER

[75] Inventor: Martin E. Wilson, Covington, Ohio

[73] Assignee: The B. F. Goodrich Company, Akron, Ohio

[21] Appl. No.: 302,522

[22] Filed: Jan. 27, 1989

Related U.S. Application Data

[60] Division of Ser. No. 185,576, Apr. 25, 1988, Pat. No. 4,835,826, continuation-in-part of Ser. No. 936,573, Dec. 1, 1986, abandoned.

[51] Int. Cl.[5] ..... B21C 37/30

[52] U.S. Cl. ..... 29/90.01; 29/90.5

[58] Field of Search ..... 72/80–85; 407/8–10; 29/90.01, 90.5

[56] References Cited

U.S. PATENT DOCUMENTS

| | | | |
|---|---|---|---|
| 2,368,008 | 1/1945 | Doderer | 72/85 |
| 2,876,528 | 3/1959 | Gulpi | 29/90.01 |
| 2,977,669 | 4/1961 | Chambers | 29/90.01 |
| 4,565,081 | 1/1986 | Massee | 72/85 |
| 4,747,284 | 5/1988 | Hudson | 72/85 |

*Primary Examiner*—Bruce M. Kisliuk
*Assistant Examiner*—Jack Lavinder
*Attorney, Agent, or Firm*—Joseph Januszkiewicz

[57] ABSTRACT

A burnishing tool holder and a method of burnishing wherein the burnishing tool has a resilient U-shaped thin strip interconnected to a bracket that supports a burnishing roller and a tool holder that is mounted on a slide that is moveable longitudinally and transversely of a hollow wheel rim. The U-shaped member is yieldable along a line normal to the axis of rotation of the burnishing roller to present a variable force on the workpiece to burnish a horizontally extending surface of different thicknesses.

9 Claims, 3 Drawing Sheets

BURNISHING TOOL HOLDER

This is a division of application Ser. No. 185,576, filed Apr. 25, 1988, now U.S. Pat. No. 4,835,826, which is a continuation-in-part of Ser. No. 936,573, filed Dec. 1, 1986, abandoned.

BACKGROUND OF THE INVENTION

The present invention relates to a burnishing operation and more particularly to a burnishing tool which provides a cold-working operation on a non-linear profile and to the method of burnishing a workpiece such as an aircraft wheel.

Burnishing is often used as a finishing operation after a workpiece has been machined or ground to eliminate minute surface irregularities. Burnishing is to be distinguished from a spinning operation wherein the tool is urged against the workpiece blank which is deformed into a desired shape usually in a series of passes with substantial deformation of the material. These operations are distinct and operate under different principles. A burnishing operation as herein used is a cold-working operation which does not remove material but compresses the microscopic peaks of a metal surface into adjacent valleys as if to densify the surface thereby obtaining a superior finish that has improved physical properties. Herein the burnishing condenses the grain structure of the metal producing a superior hard, corrosion resistant long-wearing surface, free of grit, and the microscopic peaks and valleys that are inherent in metal turning operations. In many instances, the burnishing tool operates on a linear surface. An example of this is a burnishing tool composed of a series of tapered, highly polished and hardened rolls journaled in circumferentially spaced recesses of a carrier member. Each roll has its axis parallel to the axis of the carrier member and is used to burnish the inside diameter surface of a tubular product. In these instances the roller burnishing tool can be used to help achieve size control while producing a superior finish. The burnishing tool holder of the present invention is directed to the use of a narrow radius roller that not only can burnish a linear outside diameter surface but can also finish any outside diameter (O.D.) surface configuration containing fillets, radii, tapers and grooves. The burnishing tool of the present invention is mounted on a tool holder supported by a slide or turret support that is moveable in two perpendicular directions which can be dictated by a numerically controlled input means. The turret support is generally moved in its first or longitudinal direction by a feed screw that is parallel to the axis of the workpiece with the second direction being transverse thereto and for illustration purposes is numerically controlled. Such a numerically controlled path dictates the transverse movement so that the burnishing tool can effect a controlled pressure on the workpiece to effect the cold working processing. One of the most effective means for controlling such burnishing operations heretofore has been to use a pneumatic cylinder device regulated by a control valve to control the transverse movement and constant pressure. Such control valve device has the drawback in that the thrust of the burnishing tool is not sensitive enough to properly take into account the frictional forces and the rapidly changing contour of a fillet as on a wheel rim to maintain the proper pressure or when one changes from an axial movement to a compound transverse and axial movement, particularly on thin workpieces or workpieces of differential thickness. The burnishing tool of the present invention utilizes a generally U-shaped support whose bite portion has a circumferentially extending loop portion which can take into account the frictional forces and is highly responsive and sensitive to contour changes to enable the proper cold working of such surfaces. The applied pressure can be reduced when a thin wall section is encountered so that workpiece is not distorted. The present invention provides the unique feature that the compound movement of the slides that support the resilient burnishing tool can be controlled by either a cam as a template or numerically controlled which positions these slides at precise locations in their compound movement so that the resilient burnishing tool holder and burnishing tool can provide a variable force as it works on a thin walled section of a workpiece followed by a thick walled section along the same horizontal line that is parallel to the axis of rotation of the workpiece. Heretofore the regulating valve could not discern a thin walled section and would severly alter its contour or cause an undesirable flow of metal.

SUMMARY OF THE INVENTION

The present invention contemplates an apparatus and method for burnishing a contoured surface of a rotating workpiece with a narrow rotating roller whose transverse movement to the rotating axis of the workpiece is dictated by a numerical control process or a template. The tool holder for the burnishing roller includes a circumferentially extending loop that has two adjacent ends terminating into linear adjacent parallel leg members that extend radially away from the loop constructed of spring steel to provide a resilient support means for accurately effecting a controlled pressure on the burnishing tool.

DETAILED DESCRIPTION OF PREFERRED EMBODIMENT

Figure 1:
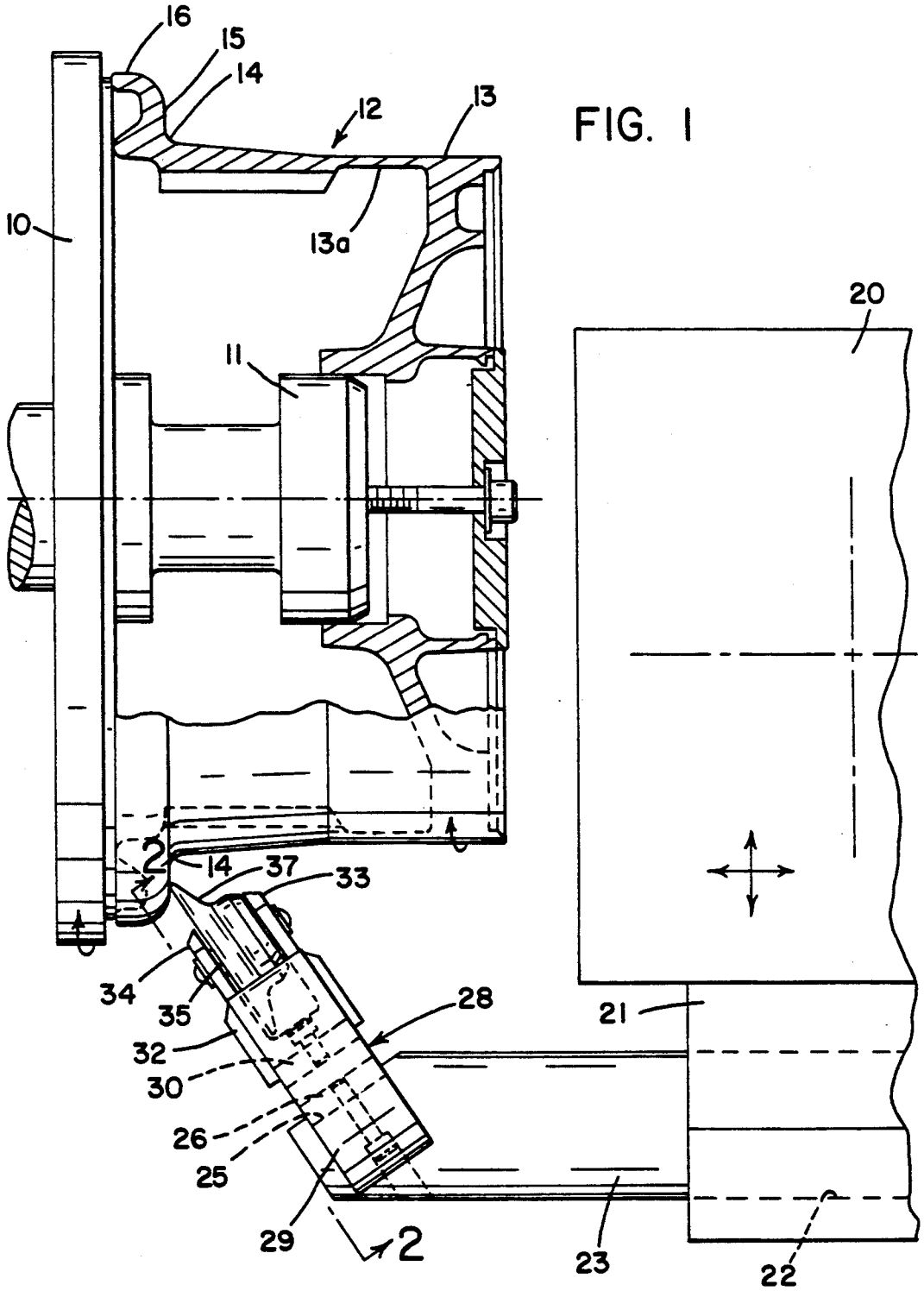
FIG. 1 is a fragmentary plan view of the workpiece, a wheel rim, partly in cross section, and the burnishing tool with slide support.

Referring to the drawings wherein like reference numerals designate like or corresponding parts throughout the several views, there is shown in FIG. 1 a headstock 10 with a chuck 11 holding a wheel rim 12. Rim 12 has cylindrical portion 13 that tapers gently radially outwardly to a fillet portion 14 and thence outwardly as at 15 to an enlarged cylindrical portion 16. The cylindrical portion 13 as seen in FIG. 1 has a thin walled portion **13*a* which as discussed hereinafter is subject to deformation or metal flow if too great a radial pressure is exerted thereon. Suitable drive means rotate the headstock 10 and the wheel rim 12**.

Mounted on suitable ways is a tool ride or turret slide 20 that supports a tool support 21. Slide 20 along with tool support 21 is adapted to be moved longitudinally and transversely to the axis of rotation of the headstock and wheel rim 12 in a manner old and well known in the art.

Tool support 21 extends laterally outwardly from slide 20. Tool support 21 has a bore 22 that receives a tool bar or tool holder 23 that is suitably secured thereto in a manner old and well known in the art. Tool holder 23 has a vertically disposed recess 25 receiving and secured to one leg 26 of a generally U-shaped metal spring or resilient member 28 that has a bite portion with a circumferentially extending loop 29 that terminates into a leg member 30 that lies closely adjacent to and parallel to leg member 26. Leg member 30 is also received in a vertically disposed recess 31 and secured to a tool bracket 32 which has two bifurcated portions 33 and 34 which receive an axle 35 for rotatably supporting a burnishing roller 37.

As used herein resilient means returning freely to the previous position or shape after the deforming forces are removed whereas flexible has the meaning of being capable of yielding to outside forces but will not necessarily return to its original position or shape. In each instant, the elastic limit of the material is not attained.

In the operation of the described apparatus, assume that the slide 20 is moving in a direction parallel to the axis of rotation of the workpiece 12 and that the burnishing tool or roller 37 is making contact with the wheel rim at the cylindrical portion 13 thereof. At this point the burnishing roller 37 effects a compacting cold working action on the material in accordance with the pressure exerted on the workpiece. The pressure applied is in accordance with the dictates of a numerically controlled path which is old and well known in the art. As the burnishing tool exerts pressure on the cylindrical portion 13, the slide 20 will move transversely away from the axis of the chuck 11 a predetermined amount as dictated by the signal from the numerically controlled input as the burnishing tool operates on the cylindrical section **13*a* to avoid any deformation due to the thinness of the rim cross-section. Then as the burnishing wheel 37 moves past the thin section 13*a*, the pressure is increased by the dictates of the signal from the input of the numerically controlled signal. Thence, the burnishing roller 37 works the tapered surface of the wheel rim 12 in accordance with the dictates of the numerically controlled path, the pressure exerted can be easily controlled however as the burnishing roller 37 encounters the rapidly changing contour of the fillet area 14, the pressure of the burnishing roller 37 can be more evenly controlled because of the resilient nature of the U-shaped metal spring 28** which permits the same exerted pressure on the workpiece to be maintained. The resiliency enhances such continued force or pressure at a precise degree because the resiliency permits a minute give in the spring while readily responding to the dictates of the control signal to effectively perform its burnishing operation.

Figure 3:
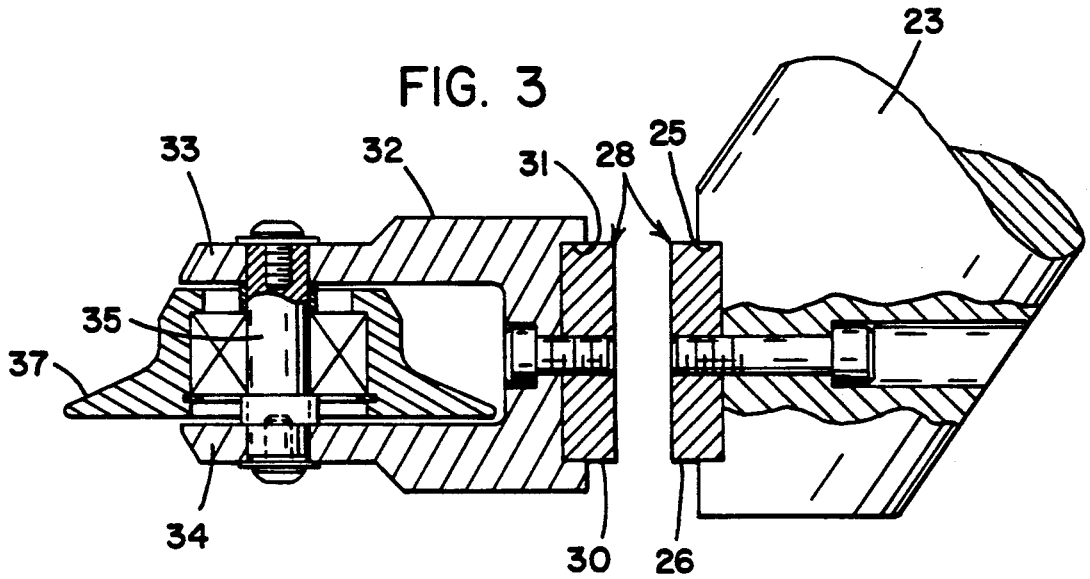
FIG. 3 is a fragmentary plan view of the burnishing tool and holder partly in section taken on line 3—3 of FIG. 2.
Figure 4:
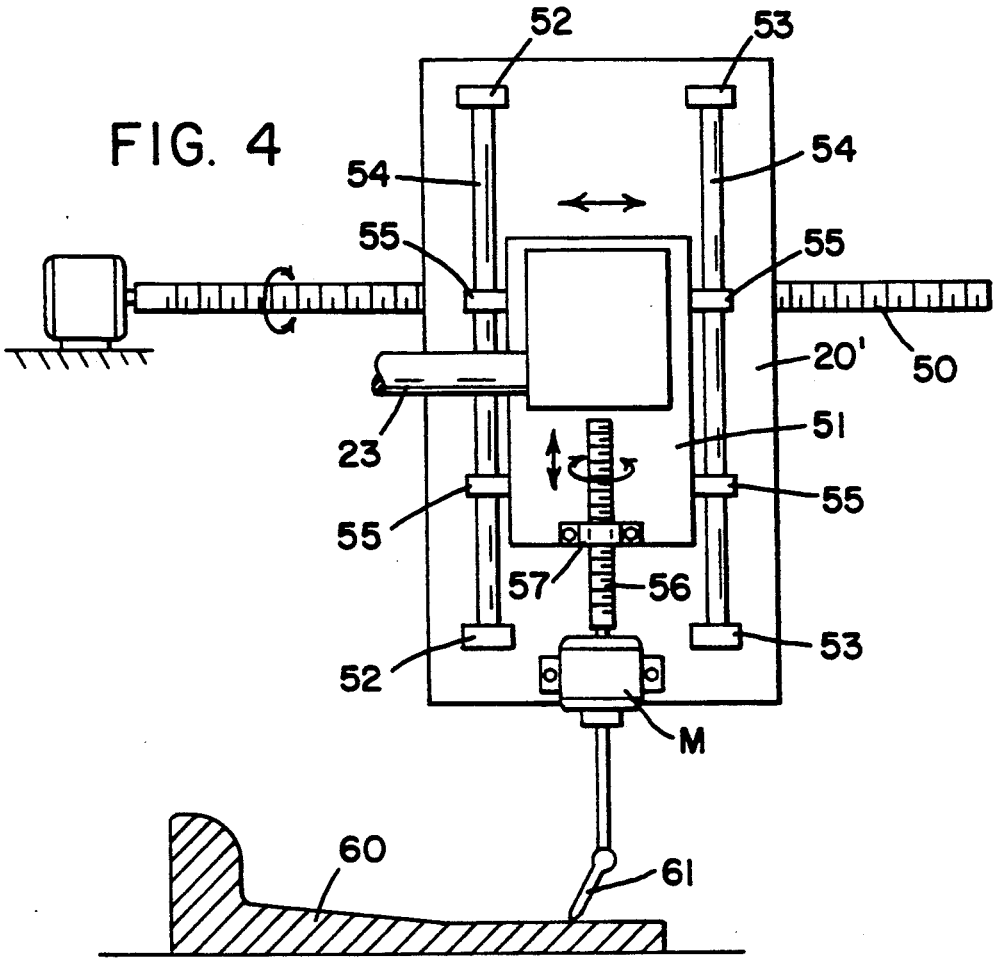
FIG. 4 is a fragmentary schematic, plan view of a lathe slide showing a template controlling a slide and a tool slide which would carry the burnishing tool holder and burnishing tool.
Figure 5:
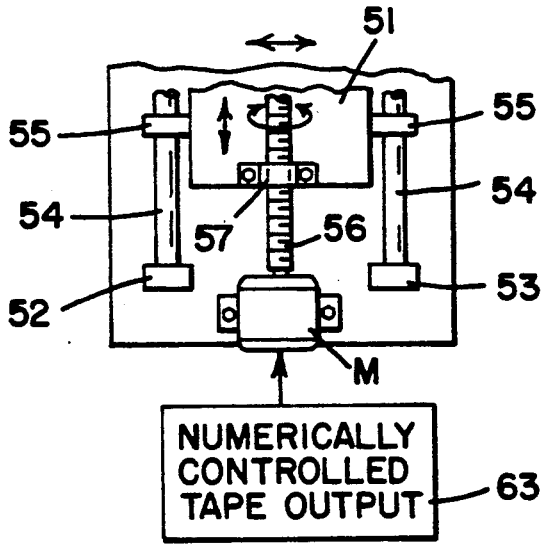
FIG. 5 is a fragmentary schematic view of a motor control for a tool slide via an output from a numerically controlled tape.

The above described invention is further illustrated by FIGS. 4 and 5 wherein a tool slide 20' is shown movable in a direction parallel to the axis of rotation of the workpiece by a lead screw 50. Mounted on such slide 20' is a tool holder 51. Mounted at the respective ends of tool slide 20' are a pair of aligned blocks 52, 53. Each pair of blocks 52–53 support a cylindrical bar 54 which act as ways for tool holder 51. The respective sides of tool holder 51 has a pair support member 55 with aligned bores for receiving the cylindrical bars 54 to facilitate the transverse movement of tool holder 51 on tool slide 20'. Mounted on tool slide 20' is a variable speed motor M which provides for rotation of a feed screw 56. Feed screw 56 is journaled in a stationary nut 57, which nut is secured to the tool holder 51. Thus rotation of the feed screw 56 controls the transverse movement of tool holder 51 and tool holder 23 as descried and shown in FIGS. 1, 2 and 3. Such tool holder 23 supports the same U-shaped resilient member 28 and the burnishing roller 37 as described above. The motor M is controlled by a cam or template 60 in response to a follower means 61 via either an electrical means or a mechanical cam follower. A further alternative to controlling the actuation of motor M and the burnishing tool it supports is a numerically controlled tape output means 63, well known in the art. Tracer control means is described in "Tool Engineers' Handbook" (1949) pages 540 and 541.

Figure 2:
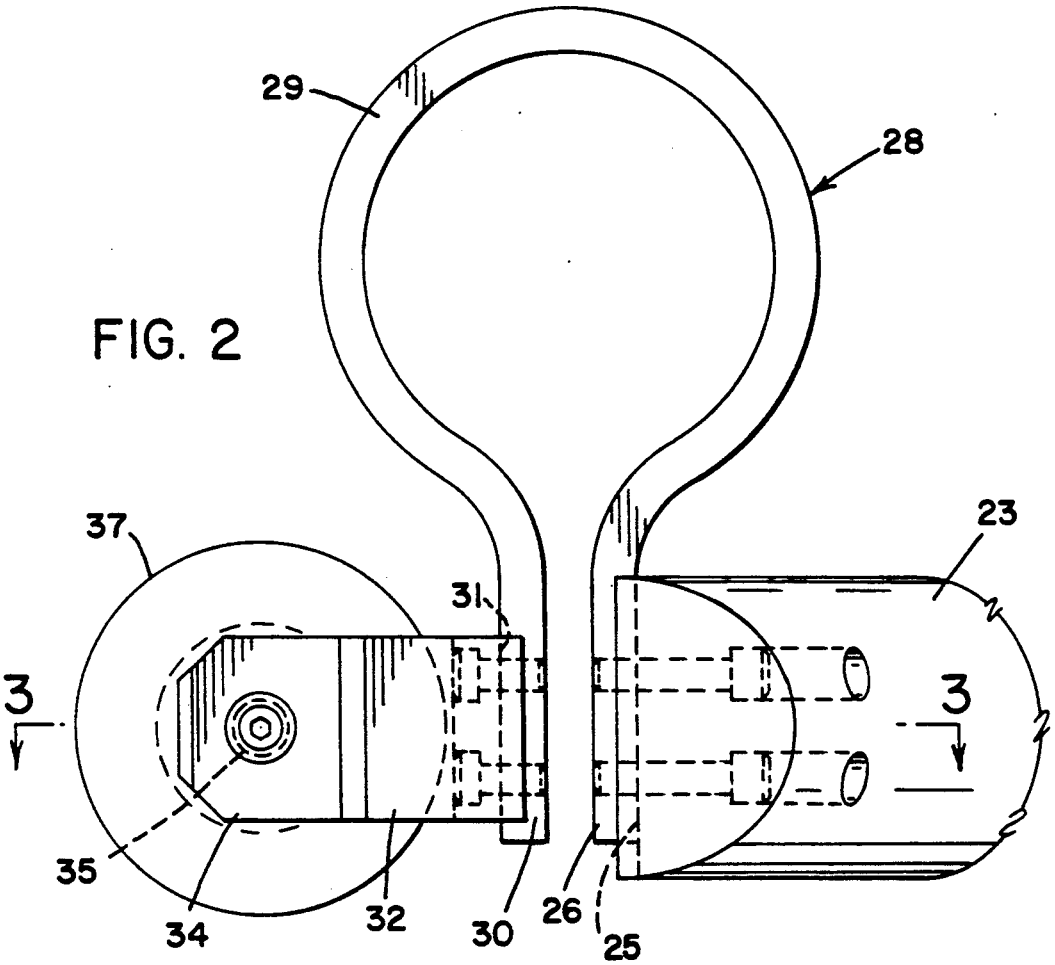
FIG. 2 is an enlarged side elevational view of the burnishing tool and holder taken on line 2—2 of FIG. 1.

The method for burnishing the workpiece which is shown in FIG. 1 includes the actuation of motor M and the motor that controls the rotation of lead screw 50 by either the numerically controlled tape output 63 or by the template 60 and its follower 61 which permits the burnishing roller 37 to perform its burnishing operation on the wheel rim 12. As the wheel rim 12 rotates, the burnishing roller 37 first contacts the cylindrical portion 13 and exerts a first force, thence as the surface **13*a* is contacted, the loading force is retracted slightly by moving the tool holder 51 rearwardly from the workpiece even though the surface 13*a* and 13 are on the same horizontal plane. This can be accomplished because of the resiliency of the U-shaped metal spring or resilient member 28 as depicted by FIGS. 1 through 3 and described above. Thence the burnishing roller 37 works on the concave portion 14 followed by the convex radius 16. The linear cylindrical portions 13 and 13*a* are often referred to as the bead ledge, while concave radius area 14 is referred to as the bead seat radius and the convex area 16** is referred to as the heel radius.

Various modifications are contemplated and may obviously be resorted to by those skilled in the art without departing from the described invention, as hereinabove defined by the appended claims, as only a preferred embodiment thereof has been disclosed.

I claim:

1. In an apparatus for burnishing a workpiece consisting essentially of a lathe with a headstock, chuck means mounted in said headstock for holding a workpiece for rotation about a first axis, slide member means mounted on said lathe for movement along a first path parallel to said first axis and along a second path transverse to said first axis, a tool holder mounted on said slide member means for movement therewith, a resilient generally U-shaped member with spaced leg members, one of said leg members is secured to said tool holder, the other one of said leg members is secured to a bracket member, said generally U-shaped resilient member having a circumferentially extending loop portion that interconnects said leg members, a burnishing roller mounted on said bracket member for effecting a burnishing operation on said workpiece, input means connected to said slide member means for moving said slide member means along with said tool holder and said one leg member of said resilient U-shaped member along said first path and said second path, said input means being the sole force producing means between said input means and said one leg member that is secured to said tool holder that supports said U-shaped resilient member, and said U-shaped resilient member modifying such force on said workpiece by said burnishing roller as said input means operates on said slide member means once said burnishing roller contacts said workpiece while moving said slide members along said first path and said second path.

2. In an apparatus for burnishing as set forth in claim 1 wherein said circumferential loop is over 220 degrees between said leg members and yieldable in a direction normal to said axis of rotation of said burnishing roller.

3. In an apparatus for burnishing as set forth in claim 2 wherein said tool holder is moved with said slide member means and said resilient member and burnishing roller along said first and second paths in response to a numerically controlled output to said input means to thereby produce a force from said burnishing roller onto said workpiece that may be variable in accordance with said numerically controlled output.

4. In an apparatus for burnishing as set forth in claim 2 wherein said resilient generally U-shaped member with said circumferential loop is a thin flat strip that yields along a line that intersects the axis of said burnishing roller and passes through the juncture of said strip to said tool holder and said bracket member.

5. In an apparatus for burnishing as set forth in claim 4 wherein said burnishing roller has a narrow width with a sharp radius presenting a narrow profile for burnishing.

6. In an apparatus for burnishing a workpiece having a lathe with a headstock, chuck means mounted in said headstock for holding an aircraft wheel with a linear and curved profile for rotation about a first axis, slide means mounted on said lathe for movement along a path parallel to said first axis and transverse to said first axis, a tool holder mounted on said slide means for movement therewith, a resilient generally U-shaped member with spaced leg members, one of said leg members is secured to said tool holder, the other one of said leg members is secured to a bracket member, said generally U-shaped resilient member having a circumferentially extending loop portion that interconnects said leg members, a burnishing roller mounted on said bracket member for effecting a burnishing operation on said workpiece, means for urging said burnishing wheel against said aircraft wheel and consisting essentially of an input means which determines said slide means movement along said first axis and movement transverse to said first axis to thereby maintain said burnishing roller in engagement with said aircraft wheel and maintain a force thereagainst that is proportional solely to said input means which may be a variable force on said linear and curved profile of said aircraft wheel.

7. In an apparatus for burnishing as set forth in claim 6 wherein said circumferential loop is over 220 degrees between said leg members and yieldable in a direction normal to said axis of rotation of said burnishing roller while said burnishing roller is in engagement with said workpiece.

8. In an apparatus for burnishing as set forth in claim 7 wherein said input means is numerically controlled.

9. In an apparatus for roll-burnishing an aircraft wheel with a linear and curved profile consisting essentially of a slide member means which moves longitudinally and transversely with respect to the aircraft wheel, control input means connected to said slide member means for operatively controlling said longitudinal and transverse movement, a U-shaped spring member, said spring member having a pair of spaced leg members, one of said leg members mounted on said slide member means for movement therewith, a burnishing roller journaled on the other one of said leg members for engagement with such aircraft wheel, said control input means providing a force by said burnishing roller on said aircraft wheel that is proportional solely to said input means as modified by said U-shaped spring member for forcing said burnishing roller into engagement with such linear and curved profile of such aircraft wheel as said input means is transmitted to said burnishing roller via said U-shaped spring member that interconnects said leg members.

* * * * *